US006058910A

United States Patent [19]

Simmons et al.

[11] Patent Number: 6,058,910

[45] Date of Patent: May 9, 2000

[54] ROTARY DISTRIBUTOR FOR A HIGH PRESSURE FUEL SYSTEM

[75] Inventors: Scott R. Simmons; John D. Lane; Mark S. Cavanagh; Alfred R. Nerz, all of Columbus; Frank R. Hunt, Seymour; Gordon K. Butler, Crothersville; Bela Doszpoly, Columbus, all of Ind.

[73] Assignee: Cummins Engine Company, Inc., Columbus, Ind.

[21] Appl. No.: 09/060,178

[22] Filed: Apr. 15, 1998

[51] Int. Cl.[7] ..... F02M 37/04

[52] U.S. Cl. ..... 123/450; 123/41.31; 417/462

[58] Field of Search ..... 123/41.31, 450; 417/462

[56] References Cited

U.S. PATENT DOCUMENTS

| | | |
|---|---|---|
| 2,446,497 | 8/1948 | Thomas . |
| 2,515,033 | 7/1950 | Connor . |
| 2,716,944 | 9/1955 | Ferris . |
| 2,775,233 | 12/1956 | Bischoff et al. . |
| 2,910,976 | 11/1959 | Fancher . |
| 4,336,781 | 6/1982 | Overfield . |
| 4,357,925 | 11/1982 | Woodruff . |
| 4,426,977 | 1/1984 | Taplin et al. . |
| 4,430,047 | 2/1984 | Ilg . |
| 4,438,747 | 3/1984 | Skinner et al. . |
| 4,480,623 | 11/1984 | Thomas . |
| 4,531,488 | 7/1985 | Kawamura et al. . |
| 4,554,901 | 11/1985 | Gibson et al. . |
| 4,557,237 | 12/1985 | Bally et al. . |
| 4,601,274 | 7/1986 | Seilly . |
| 4,624,231 | 11/1986 | Fenne . |
| 4,625,694 | 12/1986 | Adey et al. . |
| 4,802,453 | 2/1989 | Thornthwaite . |
| 4,915,592 | 4/1990 | Hishinuma et al. . |
| 5,012,785 | 5/1991 | Long et al. . |
| 5,245,971 | 9/1993 | Rembold ..... 123/450 |
| 5,354,183 | 10/1994 | Eisenbacher et al. . |
| 5,413,081 | 5/1995 | Collingborn ..... 123/450 |
| 5,613,839 | 3/1997 | Buckley ..... 123/450 |
| 5,619,971 | 4/1997 | Kubo et al. . |
| 5,630,398 | 5/1997 | Gant et al. . |
| 5,692,475 | 12/1997 | Rodriguez-Amaya ..... 123/450 |
| 5,713,333 | 2/1998 | Cooper ..... 123/450 |
| 5,782,620 | 7/1998 | Nothdurft ..... 123/450 |
| 5,806,493 | 9/1998 | Kubo ..... 123/450 |

FOREIGN PATENT DOCUMENTS

| | | |
|---|---|---|
| 0 524 132 | 1/1993 | European Pat. Off. . |
| 561475 | 4/1957 | Italy . |
| 59-110835 | 6/1984 | Japan . |
| 2-104964 | 4/1990 | Japan . |
| 860015 | 2/1961 | United Kingdom . |

*Primary Examiner*—Carl S. Miller

*Attorney, Agent, or Firm*—Nixon Peabody LLP; Charles M Leedom, Jr.; Tim L Brackett, Jr.

[57] ABSTRACT

An improved rotary fuel distributor is provided which effectively dynamically centers the rotor during operation while actively cooling the rotor and refilling fuel passages to minimize cavitation. A pressure balancing system is provided which includes pressure area defining grooves formed adjacent a rotor outlet port to control the pressure gradient in the clearance between the rotor and the distributor housing thereby effectively providing a more predictable force component which can be controlled to more effectively balance the rotor in conjunction with two balancing ports positioned on the opposite side of the rotor from the outlet port. A refill and cooling system is provided to continuously and actively cool the rotor with cool, low pressure fuel throughout rotation thereby displacing the hot fuel with cool fuel and effectively preventing thermal seizure of the rotor. The refill and cooling system also includes passages for effectively refilling delivery passages formed in the distributor housing while intermittently refilling supply passages with cool, low pressure fuel after each injection event.

53 Claims, 3 Drawing Sheets

ROTARY DISTRIBUTOR FOR A HIGH PRESSURE FUEL SYSTEM

TECHNICAL FIELD

This invention relates to an improved rotary fuel distributor for a high pressure fuel system which effectively enables the delivery of precise quantities of fuel to a plurality of engine cylinders while minimizing side loading, thermal wear and seizure of the distributor rotor.

BACKGROUND OF THE INVENTION

Many fuel injection systems for internal combustion engines use a fuel distributor for delivering fuel to fuel injectors associated with respective engine cylinders. The distributor functions to fluidically connect a supply fuel passage to each fuel injector or engine cylinder one at a time through separate fuel injection lines extending from the distributor to each injector. The conventional rotary distributor includes a rotor shaft rotatably mounted in a bore formed in a distributor housing. The shaft typically includes a radial supply passage and a radial fuel outlet port, axially spaced from the supply passage, and fluidically connected with one another by means of an axial passage in the shaft. The distributor housing includes a plurality of fuel distribution passages having ports evenly spaced around the circumference of the bore. During shaft rotation, the outlet port sequentially aligns or registers with the fuel delivery passages to permit fuel delivery to each engine cylinder. Each period of time defined by the alignment of the outlet port and a delivery passage creates a window of opportunity for injection, during which a controlled quantity of fuel is delivered through the aligned passages to an injector associated with a given engine cylinder. During operation, the shaft is operatively connected to the engine crankshaft, which provides the power for continuous rotation.

Although the conventional rotary distributor operates adequately to create sequential windows of opportunity for delivering metered quantities of fuel, certain problems exist when a rotary distributor is used in a very high pressure fuel system capable of achieving pressures in excess of approximately 15,000 psi. Recent and upcoming legislation resulting from a concern to improve fuel economy and reduce emissions continues to place strict emission standards on engine manufacturers. In order for new engines to meet these standards, it is necessary to produce fuel injection systems capable of achieving higher injection pressures while maintaining accurate and reliable control of the metering and timing functions. One such high pressure fuel injection system is disclosed in PCT Publication No. WO 94/27041 entitled *Compact High Pressure Fuel System with Accumulator,* commonly assigned to the assignee of the present application, wherein an accumulator temporarily stores fuel supply by high pressure variable displacement pump for delivery to a distributor via a solenoid controlled three-way valve. This system is capable of achieving extremely high injection pressures in excess of 20,000 psi. This rotary distributor relies on a clearance fit between the rotor and the bore, and very short sealing lengths, to isolate the high pressure injection occurring in one delivery passage from the remaining passages. At high injection pressures, fuel leakage through the clearance between the shaft and bore becomes unacceptable. More importantly, the extremely high pressure fuel existing in the clearance gap or region surrounding the outlet port formed in the rotor, acts on the surface of the rotor to create a side load or force tending to move the rotor toward the opposite side of the bore. One or more unpressurized ports formed in the distributor housing on the opposite side of the bore interrupt the bearing surface which is used to support the side load. As a result, the fuel between the bearing surface and the rotor is squeezed out by the side loading, causing bending of the rotor and contact between the rotor and the bore surface and ultimately resulting in seizure of the rotor in the bore. The severity of the side loading is increased as the injection pressure, and injection event duration, are increased as required by modern fuel systems. Another important problem experienced in conventional rotary distributors is thermal seizure. The fuel in the clearance region between the rotor and bore experiences excessive heating during operation due to high pressure leakage, flow restriction, compression, friction due to rotor-to-housing contact, and the collapsing of vaporized fuel, i.e. cavitation. Of course, the aforementioned increased side loading causes higher heat loads from contact and leakage. Even if the side loading problem is minimized, the heat load increases with increasing injection pressure (more fuel spilling during depressurization thus increasing leakage and cavitation) and decreasing fueling amount (more pressurization/depressurization cycles for a given fuel volume). In conjunction with cavitation heat loads, heating occurs in the surface passages on the rotor due to fuel spilling during depressurization. This localized heating can cause local expansion of the rotor resulting in a press-fit between the rotor and opposing housing wall thereby resulting in seizure.

U.S. Pat. No. 5,619,971 issued to Kubo et al. discloses a rotary distributor including a pressure balancing feature for balancing the fluid pressure forces acting on the rotor so as to prevent seizure. In a conventional manner, the rotor includes an axial supply passage which supplies high pressure fuel to a radial passage leading to a distribution port formed in the outer surface of the rotor. The pressure balancing feature includes two ports connected to the axial supply passage and positioned in such a manner that is not offset in the direction of the axis from the opening of the distribution port. The ports are formed so as to be offset symmetrically in the direction of the circumference of the rotor relative to the distribution port. The ports are formed in such a manner that they will not communicate with any of the delivery passages formed in the distributor housing when the distribution port is in communication with any one of the delivery passages. In addition, the total of the opening areas of the ports is approximately equal to the opening area of the distribution port. Thus, during an injection event, high pressure fuel is supplied to the distribution port and the pressure balancing ports. Kubo asserts that the pressure force on the rotor developed at the distribution port is cancelled out by the total of the forces applied by high pressure fuel acting at the opposite ports thereby balancing the pressure and preventing rotor seizure. Kubo et al. also suggests forming flow passages in the outer surface of the rotor for directing high pressure fuel to the delivery passages formed in the distributor housing between injection events and subsequently draining fuel from the passages prior to the next injection event for the particular delivery passage. Thus, these passages are used to supply cooling and lubricating fuel to the clearance gap between the rotor and housing bore.

Although the Kubo et al. distributor may function adequately to distribute fuel in certain applications, the Kubo et al. distributor does not effectively reduce side loading nor effectively cool the distributor rotor sufficiently in many high pressure applications. Specifically, the ports used to balance the distribution port pressure forces do not create a totally pressure balanced rotor thereby resulting in excessive side loading at high injection pressures. Also, the coolant flow path is merely provided intermittently during operation and therefore fails to adequately cool the fuel in the clearance gap between the rotor and opposing housing wall, and the rotor and housing surfaces. Moreover, the Kubo et al. coolant system uses fuel having an undesirably high temperature.

Consequently, there is a need for an improved rotary fuel distributor capable of effectively and reliably distributing high pressure fuel to the cylinders of an engine while minimizing side loading of the distributor rotor and high temperatures thereby avoiding excessive rotor wear and rotor seizure.

SUMMARY OF THE INVENTION

It is an object of the invention, therefore, to overcome the disadvantages of the prior art and to provide a distributor for a high pressure fuel system capable of accurately and effectively enabling sequential distribution of fuel to the cylinders of an engine.

It is another object of the present invention to provide a rotary distributor capable of minimizing side loading and excessive heating of the rotor.

It is yet another object of the present invention to provide a distributor which effectively equalizes the pressure between injection lines while minimizing cavitation.

It is a further object of the present invention to provide a rotary distributor which minimizes thermal seizure and rotor wear.

It is a still further object of the present invention to provide a rotary distributor capable of dynamically centering the distributor rotor in the complementary bore throughout operation in a high pressure fuel system.

Still another object of the present invention is to provide a rotary distributor which minimizes leakage and reduces heating and fuel delivery loss.

Yet another object of the present invention is to provide a distributor for a high pressure fuel system which actively cools the rotor using a controlled positive flow of low pressure, relatively low temperature fuel.

A further object of the present invention is to provide a rotary distributor for a high pressure fuel system which balances the fuel pressure induced forces on the rotor while minimizing fuel pressure induced moments.

It is yet another object of the present invention to provide a rotary distributor for a high pressure fuel system which effectively defines the fuel pressure induced force acting on the rotor at the outlet and balance ports to provide optimum balancing at all pressure conditions.

Yet another object of the present invention is to provide a rotary distributor capable of effectively refilling the injection or delivery lines after each injection event with cool, low pressure fuel for a significant portion of rotor rotation.

It is yet another object of the present invention to provide a rotary distributor including cooling and refill grooves which optimally deliver low temperature fuel to injection passages for displacing hot fuel while preventing damage during cavitation refill.

These and other objects of the present invention are achieved by providing a fuel distributor for a high pressure fuel injection system capable of distributing pressurized fuel to plural fuel injection lines associated with cylinders of a multicylinder internal combustion engine, comprising a distributor housing including a supply inlet passage, a plurality of delivery passages and a bore. The fuel distributor also includes a rotor rotatably mounted in the bore, wherein the rotor includes a receiving passage for receiving supply fuel from the supply inlet passage and an outlet port formed in an outer surface of the rotor and fluidically connected to the receiving passage. The outlet port is positioned for sequential alignment with the plurality of delivery passages. Importantly, the fuel distributor may include a pressure balancing system for pressure balancing the rotor during rotation which includes a pressure area defining groove formed in the outer surface of the rotor adjacent the outlet port for defining a high pressure area on the outer surface of the rotor on which fuel acts during an injection event. The pressure area defining groove is positioned adjacent at least three sides of the outlet port and preferably formed adjacent all four sides of the outlet port. Also, preferably, the pressure area defining groove extends substantially completely around the outlet port. Moreover, the pressure limiting groove may be formed in a rectangular pattern. The pressure balancing system may further include two or more balancing ports formed in the outer surface of the rotor, angularly spaced on the rotor from the outlet port for pressure balancing the rotor during rotation. A low pressure fuel supply system is provided to provide low pressure fuel to the pressure area defining groove to ensure effective pressure area definition.

Another aspect of the present invention includes a refill and/or cooling system for refilling the plurality of delivery passages and supply passages after an injection event while cooling the rotor. The refill and cooling system includes at least one annular cooling groove formed in the outer surface of the rotor, a drain flow circuit in fluidic communication with the annular cooling groove and the low pressure fuel supply system which also supplies a flow of low pressure fuel to the annular cooling groove during rotation of the rotor. The annular cooling groove may include first and second annular cooling grooves positioned on opposite sides of the outlet port. The refill and cooling system may further include first and second refill grooves formed in the outer surface of the rotor and positioned on opposite sides of the outlet port and positioned along the principle axis of the rotor. Each of the first and second refill grooves may include a first end communicating with the pressure area defining groove and an opposite distal end. The low pressure fuel supply system functions as a continuous cooling fuel supply to the annular cooling groove via a low pressure supply passage formed in the distributor housing. The drain flow circuit is in continuous fluidic communication with the annular cooling grooves. The refill and cooling system may further function to intermittently supply refill fuel to the receiving passage and the supply inlet passage between injection events. In this case, the intermittent supply refill system includes a plurality of refill connector grooves formed in the rotor and spaced circumferentially around the outer surface of the rotor. The intermittent supply refill system further includes at least one branch passage formed in the distributor housing for sequentially communicating with the plurality of connector grooves during rotation of the rotor.

The drain flow circuit may include an annular clearance gap formed between the outer surface of the rotor and the distributor housing resulting in a self regulating drain passage. The receiving passage formed in the rotor is positioned along a longitudinal axis of the rotor on a first side of the outlet port while the annular clearance gap of the drain flow circuit is positioned along the longitudinal axis of the rotor on a second side of the outlet port opposite the first side.

The two balancing ports are preferably connected to the outlet port by respective balancing cross passages while a diagonal transfer passage extends transversely through the rotor between an annular supply groove and the outlet port to supply high pressure fuel to the outlet and balance ports.

DETAILED DESCRIPTION OF THE PREFERRED EMBODIMENT

Figure 1:
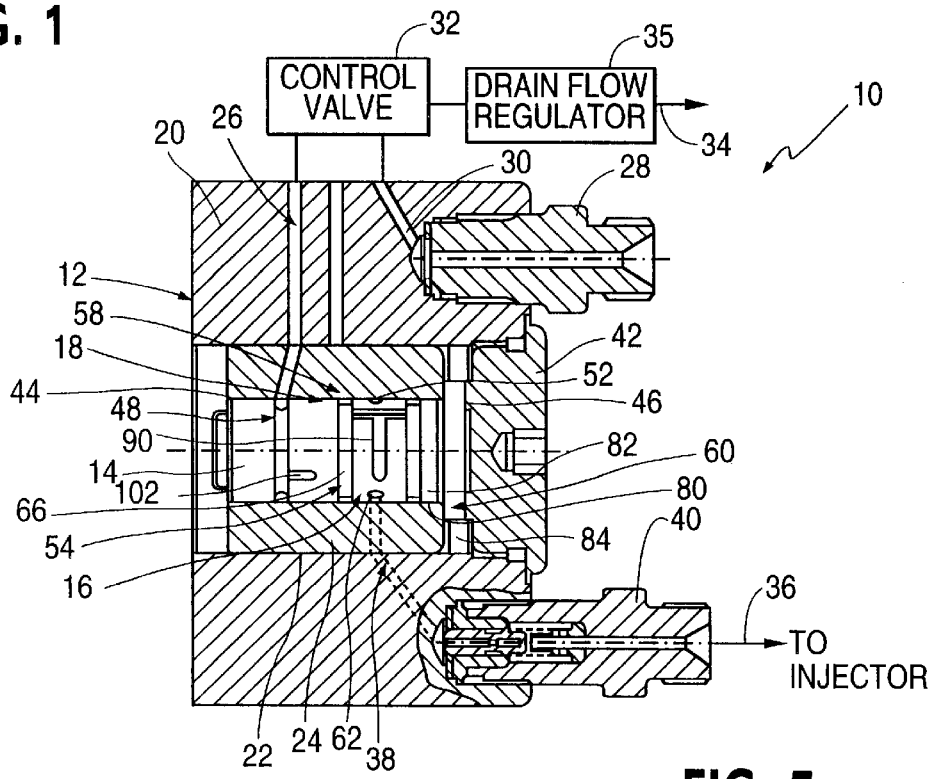
FIG. 1 is a cross sectional view of the fuel distributor of the present invention taken along plane 1—1 of FIG. 2.

Referring to FIG. 1, there is shown the rotary distributor of the present invention, indicated generally at 10, which includes a distributor housing 12, a rotor 14 rotatably mounted in housing 12, a pressure balancing system 16 for pressure balancing the rotor during rotation and a refill and cooling system 18 for refilling delivery and supply passages while cooling the rotor. As discussed more fully hereinbelow, pressure balancing system 16 and refill and cooling system 18 function to dynamically balance the rotor throughout rotation, minimize cavitation and reduce thermal loading thereby preventing rotor damage and seizure. As should be understood, the fuel distributor 10 of the present invention may be used in any high pressure fuel system wherein high pressure fuel pulses are delivered to a plurality of injectors via the distributor, such as disclosed in PCT publication number WO 94/27041 entitled *Compact High Pressure Fuel System With Accumulator,* the entire contents of which is hereby incorporated by reference.

As shown in FIG. 1, distributor housing 12 includes an outer housing 20 including a central bore 22 and a rotor sleeve 24 rigidly mounted in bore 22. Distributor housing 12 also includes a high pressure supply inlet passage 26 extending through outer housing 20 and rotor sleeve 24 for delivering high pressure fuel from a high pressure source. For example, high pressure fuel may be delivered from a high pressure accumulator through a high pressure fitting 28 mounted on outer housing 20. In this case, high pressure fuel from high pressure fitting 28 flows through a transfer passage 30 to a control valve 32. Control valve 32 functions to alternately connect supply inlet passage 26 between a drain 34 and the high pressure fuel source via transfer passage 30 thereby intermittently providing fuel pulses to fuel distributor 10 for injection through a plurality of injection lines 36 associated with cylinders of a multicylinder internal combustion engine. Of course, supply inlet passage 26 may receive high pressure fuel from any high pressure source and control system capable of controllably delivering predetermined quantities of fuel to fuel distributor 10 in timed relationship to the rotation of rotor 14.

Figure 2:
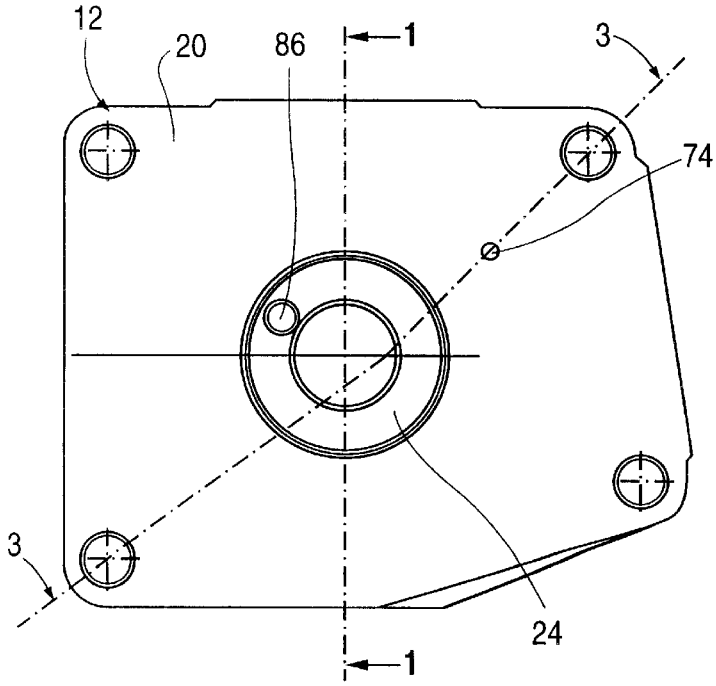
FIG. 2 is an end view of the fuel distributor of FIG. 1 taken along plane 2—2.
Figure 3:
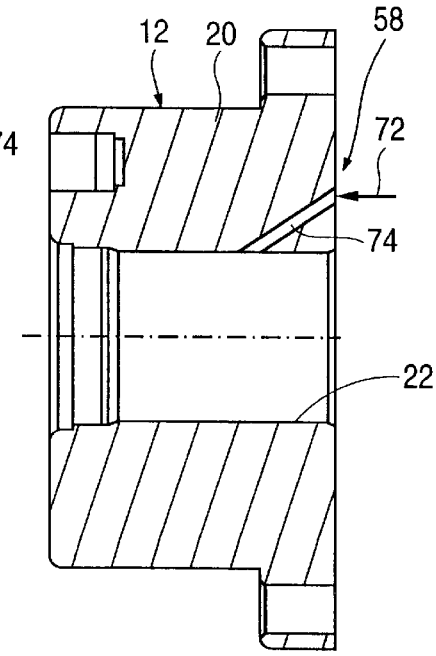
FIG. 3 is a cross sectional view of the fuel distributor of the present invention without the rotor sleeve and rotor taken along plane 3—3 in FIG. 2.
Figure 4A:
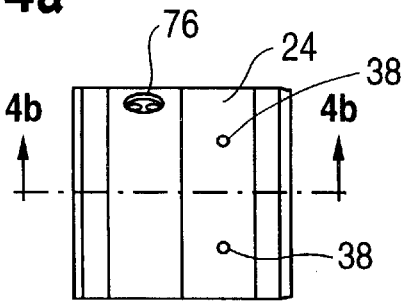
FIG. 4*a* is a side view of the rotor sleeve of the fuel distributor of FIG. 1.
Figure 4B:
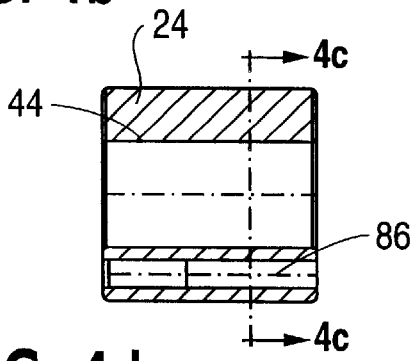
FIG. 4*b* is a cross sectional view of the rotor sleeve taken along plane 4*b*—4*b* in FIG. 4*a;*
Figure 4C:
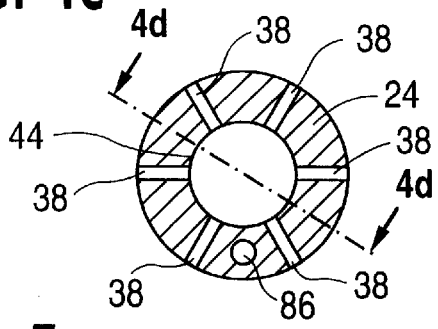
FIG. 4*c* is a cross sectional view of the rotor sleeve of FIG. 4*b* taken along plane 4*c*—4*c;*

As shown in FIGS. 4*a* and 4*c*, rotor sleeve 24 includes a plurality of delivery passages 38 extending radially outwardly through sleeve 24 and equally spaced circumferentially around sleeve 24. Delivery passages 38 also extend through outer housing 20 to communicate with one end of an outlet fitting 40 connected to one of the injection lines 36 (FIG. 1). Each outlet fitting 40 preferably includes a reverse flow restrictor or "snubber" valve for controlling backflow during depressurization thereby preventing cavitation in the injection line 36. The number of delivery passages 38, outlet fittings 40 and injection lines 36 corresponds to the number of cylinders in the engine, i.e. six. Although the present embodiment is shown for use in a six cylinder engine, fuel distributor 10 may be used in an engine having any number of cylinders by providing the corresponding number of delivery passages, outlet fittings 40 and injection lines 36. An end cap 42 is securely mounted in the outer end of bore 22 on outer housing 20 to close off and fluidically seal bore 22. As shown in FIGS. 2, 3 and 4*a*–4*d,* distributor housing 12 includes numerous other fuel flow passages associated with pressure balancing system 16 and refill and cooling system 18 as discussed more fully hereinbelow.

Referring to FIG. 1, distributor rotor 14 is rotatably mounted in an inner bore 44 formed in rotor sleeve 24. Rotor 14 is sized to provide a clearance between the outer surface of rotor 14 and the inner surface of rotor sleeve 24 forming bore 44 so as to permit smooth rotation of rotor 14 while creating an essential fluidic seal for minimizing fuel leakage. Rotor 14 includes a radial flange 46 formed at one end for positioning between end cap 42 and one end of rotor sleeve 24. Thus, rotor sleeve 24 and end cap 42 function to axially position rotor 14 while providing bearing surfaces during rotation. Rotor 14 also includes a receiving passage 48 in the form of an annular groove positioned axially along rotor 14 so as to be positioned in alignment with supply inlet passage 26. As shown in FIG. 5*b*, a diagonal transfer passage 50 extends diagonally transversely through rotor 14 from annular receiving passage 48 to an outlet port 52 formed in the outer surface of rotor 14. Outlet port 52 sequentially aligns with delivery passages 38 during rotation of rotor 14 to provide windows of opportunity for injection of high pressure fuel delivered to outlet port 52 from supply inlet passage 26, annular receiving passage 48 and diagonal transfer passage 50. Rotor 14 also includes other fuel flow passages associated with pressure balancing system 16 and refill and cooling system 18 as discussed more fully hereinbelow. Rotor 14 is operatively connected to an engine shaft (not shown) by any conventional means for securing two rotating shafts together.

Figure 6:
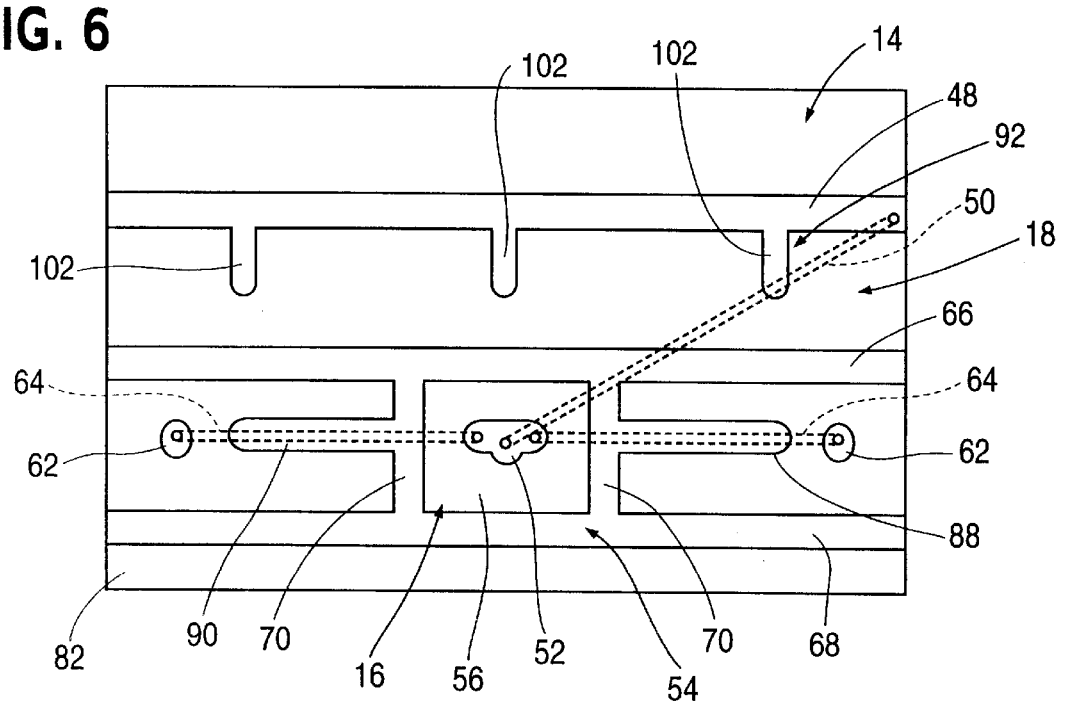
FIG. 6 is an unwrapped representation of the distributor rotor of the present invention illustrating the various pressure balancing, refill and cooling passages.

As shown in FIG. 6, illustrating an unwrapped representation of rotor 14, pressure balancing system 16 includes a pressure area defining groove 54 formed in the outer surface of rotor 14 adjacent outlet port 52. Preferably, pressure area defining groove 54 is formed adjacent all four sides of outlet port 52 and extends substantially completely around outlet port 52 to form a continuous groove. In the preferred embodiment, pressure area defining groove 54 is a continuous groove without interruption so as to permit low pressure fuel flow through the groove as described more fully hereinbelow. Pressure area defining groove 54 functions to define a high pressure area on the outer surface of rotor 14 surrounding outlet port 52. In the preferred embodiment, pressure area defining groove 54 extends in a rectangular pattern to form a rectangularly shaped pressure area 56. Pressure area defining groove 54 is maintained at a low pressure throughout operation by, for example, connecting pressure area defining groove 54 to a low pressure drain and/or supplying low pressure fuel to pressure area defining groove 54 thereby creating a low pressure flow circuit. For example, as discussed more fully hereinbelow, a low pressure fuel supply system 58 supplies low pressure fuel to pressure area defining groove 54 while a low pressure drain flow circuit 60 drains fuel from pressure area defining groove 54.

During an injection event, when outlet port 52 is in alignment with a delivery passage 38, high pressure fuel leaks into the clearance of bore 44 between rotor 14 and sleeve 24 surrounding outlet port 52. Pressure area defining groove 54 functions to specifically define the area on which fuel pressure acts during an injection event while controlling the decay of pressure along the outer surface of the rotor extending from outlet port 52. As a result, the fuel pressure induced forces acting on rotor 14 during an injection event, which cause side loading of the rotor, can be more accurately controlled and compensated for in the design of rotor 14. The force is integrated over the entire clearance region or pressure area including the outlet port. Thus, pressure area defining groove 54 allows a more accurate estimation of the pressure induced forces on the rotor during an injection event. Consequently, pressure area defining groove 54 can be designed to create the pressure area 56 necessary to balance the transverse forces acting on the rotor as discussed more fully hereinbelow.

Pressure balancing system 16 also includes a pair of balancing ports 62 formed in the outer surface of rotor 14 on the opposite side of the rotor from outlet port 52. Balancing ports 62 are each connected to outlet port 52 by a respective balancing cross passage 64 as clearly shown in FIG. 5*d*. During an injection event, high pressure fuel delivered to outlet port 52 via diagonal transfer passage 50 is also delivered to balancing ports 62 via cross passages 64. As most clearly shown in FIGS. 5*d* and 6, balancing ports 62 are positioned substantially in a common transverse plane with outlet port 52. As a result, the high pressure fuel acting on rotor 14 due to balancing ports 62, including the fuel pressure acting on rotor 14 in the clearance between rotor 14 and sleeve 24 surrounding each balancing port 62 substantially counteracts the side force created at outlet port 52 and pressure area 56. Balancing ports 62 are positioned circumferentially along the outer surface of rotor 14 so as to not communicate with delivery passages 38 when outlet port 52 is in communication with a delivery passage 38. Thus, balancing ports 62 do not interfere with the effective delivery of high pressure fuel during an injection event. In the preferred embodiment, pressure area defining groove 54 includes a first annular groove 66 positioned on one axial side of outlet port 52 and a second annular groove 68 positioned on an opposite axial side of outlet port 52. Annular groove 66, 68 extend completely around rotor 14 on either side of balancing ports 62 and thus function to define the axial extent of a pressure area surrounding balancing ports 62. The circumferential extent of the pressure area surrounding the balancing ports 62 is at least partially inherently defined by the opening of a delivery passage 38 which will be positioned on each side of a balancing port 62 during each injection event. As a result, the pressure area surrounding balancing ports 62 is sufficiently defined so as to create a more predictable pressure gradient extending from the balancing ports outwardly through the clearance between rotor 14 and sleeve 24. Thus, the side loads created by this pressure force can be more accurately determined and thus more effectively used to dynamically balance the rotor 14. Pressure area defining groove 54 further includes an axial groove 70 positioned on each side of outlet port 52 and extending between first and second annular grooves 66, 68. The balancing effect between the side forces generated at outlet port 52 and the forces generated at balancing ports 62 is best achieved by choosing the shape and size of the balancing ports 62 and outlet port 52 and then selecting the spacing of first and second annular grooves 66, 68 and/or the spacing of axial grooves 70 so as to create the necessary balancing effect. For example, increasing the spacing of axial grooves 70 increases the size of pressure area 56 thereby increasing the side loads at outlet port 52. Likewise, decreasing the spacing between axial grooves 70 decreases pressure area 56 thereby decreasing the fuel pressure induced side loading at outlet port 52.

The dynamic nature of the rotor makes balancing the side loads throughout each injection event critical. It is very important that the side loads are optimally balanced at each moment to prevent undue side loading. The present rotor is dynamically centered in that the ports are sized and positioned, and the pressure area defining grooves positioned, such that for a given range of fuel injection durations, the rotor is slightly uncentered during an initial portion of a given injection event then centered for an intermediate portion and subsequently uncentered in the opposite direction for the remainder of the injection event. This distribution of the centering throughout the injection event optimizes the pressure and delivery loads to provide the best dynamic centering possible. This shift in the centering of the rotor is due to the pressure force in the clearance around the balancing ports growing more slowly than the pressure force surrounding the outlet port. Thus, in the preferred embodiment, the resulting transient balance is side loaded towards the balancing ports during the initial portion of the injection event and then side loaded towards the outlet port toward the end of the injection event. In other words, at the beginning of the injection event there is an imbalance in favor of the outlet port so that a greater force is provided at the outlet port tending to push the rotor toward the balancing ports. However, as the injection event progresses, the pressure in the clearance surrounding the balancing ports grows more rapidly thus creating a counter force stronger than the force at the outlet port. This transient balance condition can be optimized for a particular nominal running clearance.

Figure 4D:
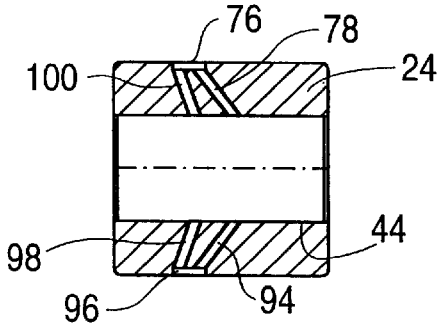
FIG. 4*d* is a cross sectional view of the rotor sleeve taken along plane 4*d*—4*d* in FIG. 4*c;*

Refill and cooling system 18 includes low pressure fuel supply system 58, drain flow circuit 60 and various passages formed in rotor 14 and distributor housing 12, including first and second annular grooves 66, 68 and axial grooves 70, for supplying relatively cool, low pressure fuel to the supply ports, outlet passages and the rotor 14 so as to prevent thermal seizure and minimize cavitation and its effects. Specifically, low pressure fuel supply system 58 includes a low pressure fuel supply 72, such as the outlet of a low pressure fuel supply pump typically used in fuel systems to supply fuel to a high pressure pump which then delivers high pressure fuel to fuel distributor 10 via control valve 32 and perhaps an accumulator. As shown in FIGS. 2 and 3, outer housing 20 includes a low pressure supply passage 74 connected to low pressure fuel supply 72 and extending from a rear face of outer housing 20 to communicate with a recess 76 formed in the outer surface of rotor sleeve 24 (FIGS. 4*a* and 4*d*). A second low pressure supply passage 78 extends from recess 76 through rotor sleeve 24 to continuously communicate with first annular groove 66 throughout rotation of rotor 14 (FIG. 4*d*). In this manner, low pressure fuel supply system 58 functions to continuously supply cool, low pressure fuel to first annular groove 66, axial groove 70 and second annular groove 68 as fuel is continuously drained from second annular groove 68 via drain flow circuit 60.

Referring to FIG. 1, drain flow circuit 60 includes an annular clearance gap 80 formed between an annular land 82 formed on rotor 14 adjacent radial flange 46. Annular land 82 is formed with a diameter sufficiently smaller than the inner diameter of bore 44 so as to permit fuel leakage through annular clearance gap 80. Cooling and refill fuel flowing from annular clearance gap 80 flows radially outwardly through an annular gap formed between radial flange 46 and rotor sleeve 24 into an annular cavity 84. Fuel in annular cavity 84 then flows through an axial drain passage 86 formed in rotor sleeve 24 (FIGS. 4*b* and 4*c*). Fuel flowing from drain passage 86 is directed back to the inlet side of the low pressure pump associated with the fuel system. In this manner, drain flow circuit 60 ensures a continuous flow of low temperature cooling and refill fuel through the rotor passages to ensure effective cooling of the rotor. Importantly, the cooling fuel cools the rotor while mixing with the hot, high pressure injection fuel leaking through clearances and carries the heat to drain without allowing hot fuel to accumulate in the clearances thereby preventing thermal seizure.

Figure 5A:
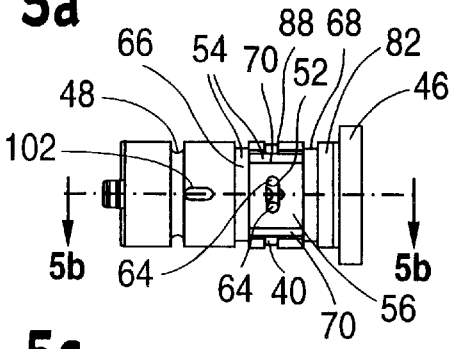
FIG. 5*a* is a side view of the distributor rotor of the present invention.
Figure 5B:
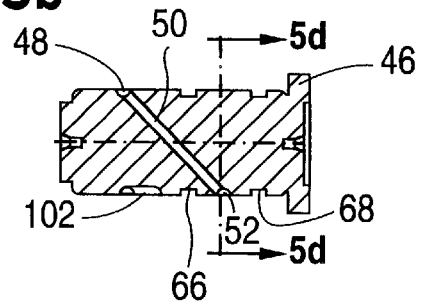
FIG. 5*b* is a cross sectional view of the distributor rotor of FIG. 5*a* taken along plane 5*b*—5*b;*
Figure 5C:
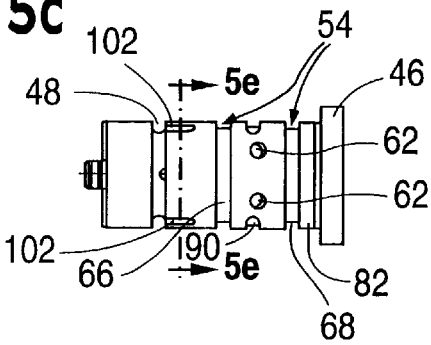
FIG. 5*c* is a side view of the distributor rotor of FIG. 5*a* rotated 180 degrees.
Figure 5D:
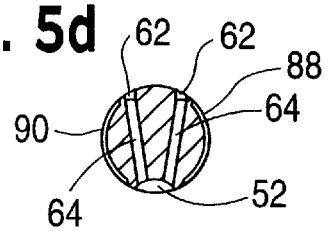
FIG. 5*d* is a cross sectional view of the distributor rotor of FIG. 5*b* taken along plane 5*d*—5*d;*

As shown in FIGS. 5*a*, 5*c* and 6, refill and cooling system 18 also includes first and second refill grooves 88 and 90, respectively, formed in the outer surface of rotor 14. Each refill groove 88, 90 extends from an axial groove 70 circumferentially away from outlet port 52 and terminates prior to a respective balancing port 62. First and second refill grooves 88, 90 are positioned in a common transverse plane with outlet port 52 and balancing port 62. As a result, during rotation of rotor 14, one of the refill grooves 88, 90 will communicate with a delivery passage 38 immediately prior to alignment with outlet port 52. Subsequently, after outlet port 52 moves out of alignment with the delivery passage 38, the other refill groove 88, 90 aligns with the delivery passage, that is, after the injection event. In this manner, first and second refill grooves 88, 90 supply cool, low pressure fuel to each delivery passage immediately before and after an injection event to ensure complete filling of the delivery passages 38 and injection lines 36 thereby minimizing cavitation and the adverse effects of cavitation while equalizing pressure between injection lines thereby reducing fueling variability. The extended length of first and second refill grooves 88, 90 ensure complete refilling of the delivery passages. As will be discussed hereinbelow, refill and cooling of delivery passages 38 is also accomplished via balancing port 62.

Figure 5E:
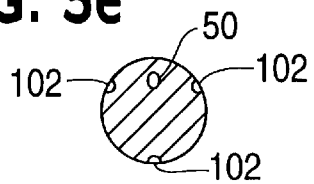
FIG. 5*e* is a cross sectional view of the distributor rotor of FIG. 5*c* taken along plane 5*e*—5*e;*

As shown in FIGS. 4*d*, 5*a*, 5*c* and 6, refill and cooling system 18 also includes an intermittent cooling flow supply system indicated generally at 92 which functions to intermittently supply cool, low pressure fuel to the high pressure supply inlet circuit or passages to ensure refill during depressurization thereby minimizing cavitation and its adverse effects. Intermittent cooling flow supply system 92 includes a third low pressure supply passage 94 extending diagonally through rotor sleeve 24 from bore 44 to connect with a recess 96 formed on a side of rotor sleeve 24 opposite recess 76 (FIG. 4*d*). Intermittent cooling flow supply system 92 also includes a first refill and cooling branch passage 98 extending from recess 96 radially inward to communicate with bore 44, and a second refill and cooling branch passage 100 extending between recess 76 and bore 44. Intermittent cooling flow supply system 92 also includes a plurality of refill connector grooves, i.e. three, formed in the outer surface of rotor 14 and extending axially from annular receiving passage 48 axially toward, and terminating prior to, first annular groove 66 (FIGS. 5*c* and 5*e*). Refill connector grooves 102 are spaced equally around the circumference of rotor 14 so as to intermittently communicate with first and second refill and cooling branch passages 98 and 100 during rotation of rotor 14. Refill connector grooves 102 and branch passages 98 and 100 are positioned so as to only intermittently align when outlet port 52 is positioned between, that is, out of alignment with, delivery passages 38 between injection events. Thus, since refill connector grooves 102 are positioned 120 degrees apart (FIG. 5*e*) and first and second refill and cooling branch passages 98 and 100 are positioned 180 degrees apart (FIG. 4*d*), a refill connector groove 102 will register with one of the first and second refill and cooling branch passages 98, 100 every 60 degrees of rotation of rotor 14, for the six cylinder embodiment shown. When one of the refill connector grooves 102 aligns with first refill and cooling branch passage 98, cool, low pressure fuel is delivered from first annular groove 66 through third low pressure supply passage 94 and recess 96 into refill connector groove 102 via first branch passage 98. When one of the refill connector grooves 102 aligns with second refill and cooling branch passage 100, cool, low pressure fuel is delivered directly from low pressure supply passage 74 without flow through first annular groove 66. The cool, low pressure fuel flows from refill connector groove 102 into annular receiving passage 48 and supply inlet passage 26 during depressurization of supply inlet passage 26 between injection events. Thus, after each injection event, intermittent cooling flow supply system 92 provides a flow of cool, low pressure fuel to receiving passage 48 and supply inlet passage 26 thereby collapsing any gaseous pockets due to cavitation. Also, since cooler fuel has lower vaporization pressure, the cooling refill inhibits cavitation. An active flow of cooling fuel flow through receiving passage 48 and supply inlet passage 26 is achieved during each intermittent cooling period by incorporating a regulator 35 in the drain path 34 from control valve 32. When the three-way control valve 35 connects supply inlet passage 26 to drain at the end of an injection event and intermittent cooling flow supply system 92 provides cooling fuel to receiving passage 48, the high temperature fuel in supply inlet passage 26 flows through regulator 35 to drain while being displaced by the cooling fuel. Regulator 35 functions to control the flow rate of high temperature fuel to drain, and thus the flow rate of cooling fuel, so as to ensure an optimum amount of cooling while maintaining sufficient pressure in the supply passages to prevent cavitation. Regulator 35 may be a throttle orifice type regulator or may be any of the regulators disclosed in PCT Publication No. WO 94/27041 entitled *Compact High Pressure Fuel System with Accumulator,* the entire contents of which is hereby incorporated by reference.

Figure 7:
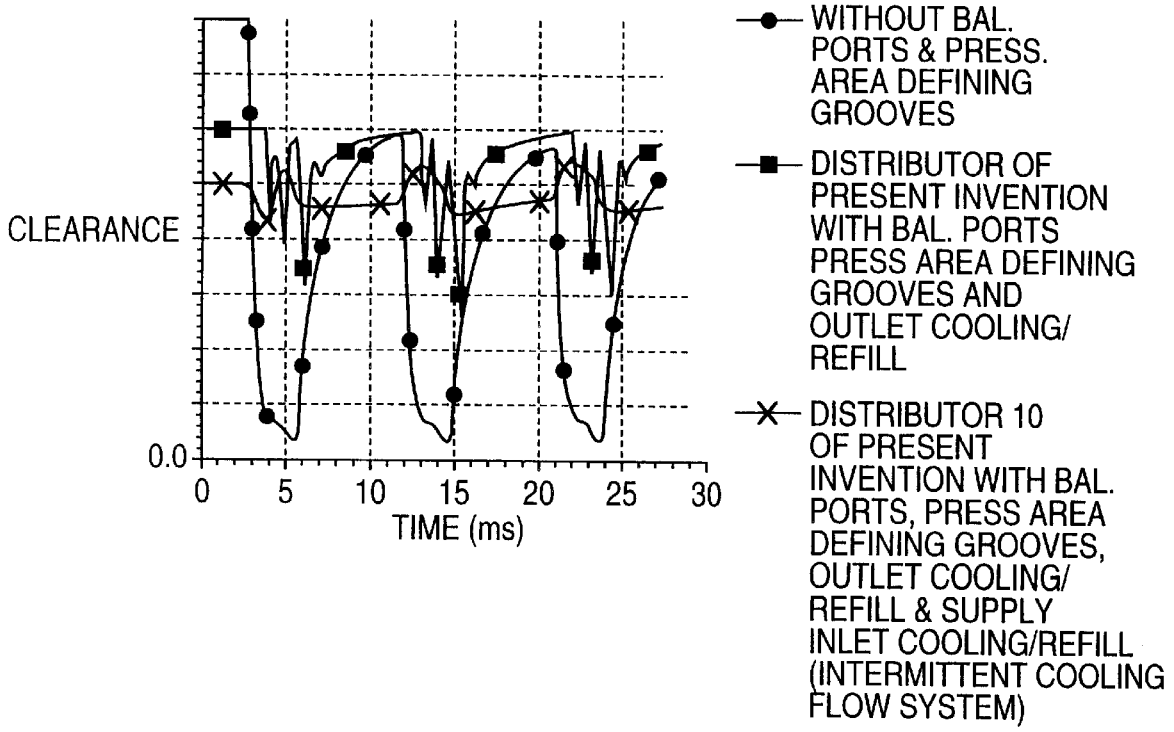
FIG. 7 is a graph showing the advantages of two embodiments of the present fuel distributor assembly in maintaining a greater minimum dynamic radial clearance between the distributor rotor and distributor housing.

Importantly, the cool, low pressure refill fuel in receiving passage 48 is also available for refilling diagonal transverse passage 50, outlet port 52 and balancing cross passages 64. Since balancing ports 62 are aligned with respective delivery passages 38 between injection events, the cool, low pressure refill fuel may flow from balancing ports 62 into delivery passages 38 thereby providing intermittent refill of delivery passages 38 in addition to the refilling function of refill grooves 88, 90. As shown in FIG. 7, intermittent cooling flow supply system 92 results in significant radial clearance reduction advantages. Clearly, intermittently cooling and refilling the supply inlet passage while also providing additional cool refill fuel to the delivery passages results in optimum dynamic rotor balancing and cooling.

Thus, refill and cooling system 18 effectively and continuously removes the heat generated during operation. This heat is generated by fuel leakage from high pressure to low pressure regions between rotor 14 and sleeve 24. This heat load can be excessive in high injection pressure applications where more fuel is spilled during depressurization. Also, high pressure operation also increases the heat load due to a decrease in fueling amount since there are more pressurization/depressurization cycles for a given fuel volume. Also, collapse of vaporized fuel, i.e. cavitation, in the various high pressure supply and delivery passages of the fuel distributor system generates additional heat. The refill and cooling system 18 functions to supply an active flow of cooling fuel through the various fuel supply passages in the distributor system, and the region or gap between the rotor 14 and sleeve 24, while also refilling the fuel passages, thereby effectively cooling the various components, specifically the rotor and sleeve, and minimizing cavitation.

The operation of the present fuel distributor 10 should be apparent from the above discussion. However, a brief summary of the operation is as follows. During rotation of rotor 14, high pressure fuel pulses are delivered by control valve 32 as control valve 32 alternately connects supply inlet passage 26 between the high pressure fuel source supplied through transverse passage 30 and a drain 34. High pressure fuel pulses are delivered only when outlet port 52 provides a window of opportunity for injection of the fuel pulse by alignment or registration with one of the delivery passages 38. Just prior to the injection event, one of the refill grooves 88, 90 has already aligned with and refilled the delivery passage 38 with cool, low pressure refill fuel. Once outlet port 52 has aligned with one of the delivery passages 38 and the injection event has been completed, the other refill groove 88, 90 comes into alignment with the delivery passage through which an injection had just occurred thereby providing cool, low pressure fuel to refill delivery passage 38 while inhibiting further cavitation. Throughout rotor rotation, low pressure fuel supply system 58 continuously supplies cool, low pressure fuel through first and second low pressure supply passages 74 and 78 into first annular groove 66. The cool, low pressure fuel flows around first annular groove 66 through axial grooves 70 and around second annular groove 68. The fuel in annular groove 68 flows through annular clearance gap 80 of drain flow circuit 60 and onto the low pressure drain via annular cavity 84 and drain passage 86. Thus, a continuous supply of cool fuel is maintained throughout operation thereby decreasing the heat generated by cavitation collapse and displacing the high temperature fuel caused by line spill and leakage thus greatly decreasing the likelihood of thermal seizure. The pressure of the cool refill fuel is maintained high enough to collapse the cavitation and equalize the line pressure between delivery passages 38 while low enough not to cause damage during the cavitation refill of the passages. The amount of cooling is controlled by the restriction of annular clearance gap 80 in the drain flow circuit 60, the cooling fuel pressure, and the relative temperatures and quantities of cooling and leakage fuel. The annular clearance gap 80 functions to effectively self regulate the flow of fuel since an increase in fuel temperature causes an increase in fuel flow through annular clearance gap 80 while a decrease in fuel temperature results in a decrease in drain flow through annular clearance gap 80. As noted above, the delivery passages 38 are also refilled with cool, low pressure fuel delivered via intermittent cooling flow supply system 92. Importantly, between injection events, intermittent cooling flow supply system 92 supplies cool, low pressure fuel to refill connector grooves 102 and thus to receiving passage 48 and supply inlet passage 26. During an injection event, the side load on rotor 14 created by high pressure fuel forces acting on pressure area 56 is compensated for by a substantially equal and opposite force generated at balancing ports 62. Pressure balancing system 16, including each of the passages which function to define the pressure area including pressure area defining groove 54 and first and second annular grooves 66 and 68, permit rotor 14 to be designed to allow the rotor to be substantially dynamically balanced throughout operation thereby preventing significant side loading and bending of the rotor.

Fuel distributor 10 of the present invention has many advantages over conventional rotary fuel distributors. First, pressure balancing system 16 functions to achieve optimum dynamic centering of the rotor throughout operation and even when subjected to very high injection pressures which cause excessive side loading in conventional distributors. Conventional rotary distributors have no balancing mechanism or merely include a pair of high pressure ports intended to balance the rotor. However, it has been found that the pressure force acting in the clearance between the rotor and distributor housing results in an unpredictable load on the rotor from one injection event and/or operating condition to another and can cause significant bending of the rotor resulting in rotor wear and thermal seizure. The pressure area defining grooves of the present invention effectively contain, and also reduce, the effective area acted on by the fuel pressure in the clearance thereby producing a more predictable and controllable side load force component which can be selected, by varying, for instance, the position of the pressure area defining grooves, to more effectively and accurately balance the side loads on the rotor thereby permitting effective operation of the rotor at extremely high injection pressures while avoiding excessive side loading and seizure problems. In addition, refill and cooling system 18 of the present invention effectively functions to actively and continuously cool the outlet side of the distributor by supplying cool, low pressure fuel throughout operation and permitting the cool, low pressure fuel to displace hot fuel to drain flow circuit 60 thereby ensuring effective cooling of the distributor and thus avoiding thermal seizure. In addition, refill and cooling system 18 effectively functions to ensure cooling and refill of the delivery passages 38 with cool, low pressure fuel unlike conventional distributors which use high pressure and/or hot fuel, such as fuel spilled during the previous cycle. Thus, refill and cooling system 18 more effectively collapses any cavitation gas with minimal surface damage and heating while also inhibiting cavitation due to the lower vaporization pressure of the cooler fuel. In addition, intermittent cooling flow supply system 92 also functions to intermittently refill the delivery passages 38 thereby ensuring proper refill while importantly refilling the supply passages after each injection event during depressurization to thereby also collapse any cavitation gas while inhibiting cavitation. Moreover, effective refilling of all of the flow passages ensures consistent, predictable injection events by reducing pressure and response time variability between injection events due to cavitation gas and variations in pressures between the injection lines. Intermittent cooling flow supply system 92 also reduces risk of thermal seizure on the inlet side of the rotor by supplying cooling fuel to the supply passages.

The combination of optimum pressure balancing and optimum cooling of both the outlet ports and the supply inlet passages to resist thermal seizure also permits the fuel distributor 10 of the present invention to operate at a lower initial radial clearance between the rotor and opposing distributor sleeve wall than previous designs and still have a higher minimum dynamic clearance during the injection event. As shown in FIG. 7, the radial clearance between the rotor and the opposing sleeve wall of the present fuel distributor 10 is decreased substantially throughout operation by combining the pressure balancing system 16 and the outlet cooling and refilling of the refill and cooling system 18. Further substantial reductions in the required radial clearance is achieved by fuel distributor 10 of the preferred embodiment by incorporating intermittent cooling flow supply system 92. The present fuel distributor 10 clearly provides optimum centering of the rotor thereby minimizing rotor distortion and bending thus greatly reducing the likelihood of side load induced scuffing and seizure while effectively cooling the rotor to prevent thermal seizure and providing optimum refill to minimize cavitation refill surface damage and heating while inhibiting cavitation.

INDUSTRIAL APPLICABILITY

The rotary distributor of the present invention may be used in any combustion engine of any vehicle or industrial equipment in which accurate and reliable fuel distribution is essential. However, the fuel distributor of the present invention is particularly beneficial in applications involving extremely high injection pressures, for example, in excess of 15,000 psi.

We claim:

1. A fuel distributor for a high pressure fuel injection system capable of distributing pressurized fuel to plural fuel injection lines associated with cylinders of a multicylinder internal combustion engine, comprising:

a distributor housing including a supply inlet passage, a plurality of delivery passages and a bore;

a fuel distribution rotor rotatably mounted in said bore, said rotor including a receiving passage for receiving supply fuel from said supply inlet passage and an outlet port formed in an outer surface of said rotor and fluidically connected to said receiving passage, said outlet port positioned for sequential alignment with said plurality of delivery passages; and one or more pressure area defining grooves formed in said outer surface of said rotor adjacent said outlet port, said one or more pressure area defining grooves positioned adjacent four sides of said outlet port to define a pressure area on said outer surface of said rotor.

2. The fuel distributor of claim 1, wherein said one or more pressure area defining grooves extend substantially completely around said outlet port.

3. The fuel distributor of claim 2, wherein said one or more pressure area defining grooves extend in a rectangular pattern around said outlet port.

4. The fuel distributor of claim 1, further including refill and cooling means for refilling said plurality of delivery passages after an injection event while cooling said rotor, said refill and cooling means including at least one annular cooling groove formed in said outer surface of said rotor, a drain flow circuit in fluidic communication with said at least one annular cooling groove and a low pressure fuel supply means for supplying a continuous flow of low pressure fuel to said at least one annular cooling groove during rotation of said rotor.

5. The fuel distributor of claim 4, wherein said at least one annular cooling groove includes a first annular cooling groove positioned on one side of said outlet port and a second annular cooling groove positioned on an opposite side of said outlet port, said first and said second annular cooling grooves being in fluidic communication with said one or more pressure area defining grooves.

6. The fuel distributor of claim 4, wherein said refill and cooling means further includes first and second refill grooves formed in said outer surface of said rotor, said first and said second refill grooves positioned on opposite sides of said outlet port in a common transverse plane extending through said outlet port, each of said first and said second refill grooves including a first end communicating with said one or more pressure area defining grooves and an opposite distal end.

7. The fuel distributor of claim 4, wherein said low pressure fuel supply means further includes a low pressure supply passage formed in said distributor housing and positioned for continuous fluidic communication with said at least one annular cooling groove, said drain flow circuit being in continuous fluidic communication with said at least one annular cooling groove.

8. The fuel distributor of claim 4, wherein said refill and cooling means further functions for intermittently supplying refill fuel to said receiving passage and said supply inlet passage between injection events.

9. The fuel distributor of claim 8, wherein said receiving passage includes an annular receiving groove, said refill and cooling means including a plurality of refill connector grooves formed in said rotor and spaced circumferentially around said outer surface of said rotor, said refill and cooling means further including a refill branch passage formed in said distributor housing for sequentially communicating with said plurality of refill connector grooves during rotation of said rotor.

10. The fuel distributor of claim 9, wherein said refill branch passage is in continuous fluidic communication with said at least one annular cooling groove.

11. The fuel distributor of claim 7, wherein said drain flow circuit includes an annular clearance gap formed between said outer surface of said rotor and said distributor housing.

12. The fuel distributor of claim 11, wherein said receiving passage is positioned along a longitudinal axis of said rotor on a first side of said outlet port, said annular clearance gap positioned along said longitudinal axis of said rotor on a second side of said outlet port opposite said first side.

13. The fuel distributor of claim 1, further including two balancing ports formed in said outer surface of said rotor on an opposite side of said rotor from said outlet port for pressure balancing said rotor during rotation.

14. The fuel distributor of claim 13, further including one or more pressure area defining grooves formed in said outer surface of said rotor adjacent each of said two balancing ports, said one or more pressure area defining grooves including a first groove positioned on one side of each of said two balancing ports and a second groove positioned on an opposite side of each of said two balancing ports.

15. The fuel distributor of claim 3, wherein each of said two balancing ports is connected to said outlet port by a respective balancing cross passage.

16. The fuel distributor of claim 15, wherein said receiving passage includes an annular receiving groove formed in said outer surface of said rotor for continuous communication with said supply inlet passage, further including a diagonal transfer passage extending transversely through said rotor between said annular supply groove and said outlet port.

17. A fuel distributor for a high pressure fuel injection system capable of distributing pressurized fuel to plural fuel injection lines associated with cylinders of a multicylinder internal combustion engine, comprising:

a distributor housing including a supply inlet passage, a plurality of delivery passages and a bore;

a fuel distribution rotor rotatably mounted in said bore, said rotor including a receiving passage for receiving supply fuel from said supply inlet passage and an outlet port formed in an outer surface of said rotor and fluidically connected to said receiving passage, said outlet port positioned for sequential alignment with said plurality of delivery passages; and pressure balancing means for pressure balancing said rotor during rotation, said pressure balancing means including a pressure area defining means for defining a high pressure area on said outer surface of said rotor adjacent said outlet port on which high fuel pressure acts during an injection event, wherein said pressure area defining means includes a first pressure area defining groove formed in said outer surface of said rotor and positioned axially along said fuel distribution rotor on a first side adjacent said outlet port and a second pressure area defining groove formed in said outer surface of said rotor and positioned axially along said fuel distribution rotor on a second side opposite said first side adjacent said outlet port, said first and said second pressure area defining grooves each containing low pressure fuel during an injection event.

18. The fuel distributor of claim 17, wherein said pressure balancing means further includes two balancing ports formed in said outer surface of said rotor on an opposite side of said rotor from said outlet port for pressure balancing said rotor during rotation.

19. The fuel distributor of claim 18, wherein said pressure balancing means further includes one or more pressure area defining grooves formed in said outer surface of said rotor adjacent each of said two balancing ports, said one or more pressure area defining grooves including a first groove positioned on one side of each of said two balancing ports and a second groove positioned on an opposite side of each of said two balancing ports.

20. The fuel distributor of claim 17, wherein said pressure area defining groove extends completely around said outlet port to define said high pressure area.

21. The fuel distributor of claim 20, wherein said pressure area defining groove extends in a rectangular pattern around said outlet port.

22. The fuel distributor of claim 17, further including a low pressure fuel supply means for supplying low pressure fuel to said pressure area defining groove during rotation of said rotor.

23. The fuel distributor of claim 17, further including refill and cooling means for refilling said plurality of delivery passages after an injection event while cooling said rotor, said refill and cooling means including at least one annular cooling groove formed in said outer surface of said rotor, a drain flow circuit in fluidic communication with said at least one annular cooling groove and a low pressure fuel supply means for supplying a flow of low pressure fuel to said at least one annular cooling groove during rotation of said rotor.

24. The fuel distributor of claim 23, wherein said at least one annular cooling groove includes a first annular cooling groove positioned on one side of said outlet port and a second annular cooling groove positioned on an opposite side of said outlet port, said first and said second annular cooling grooves being in fluidic communication with said pressure area defining groove.

25. The fuel distributor of claim 23, wherein said refill and cooling means further includes first and second refill grooves formed in said outer surface of said rotor, said first and said second refill grooves positioned on opposite sides of said outlet port in a common transverse plane extending through said outlet port, each of said first and said second refill grooves including a first end communicating with said pressure area defining groove and an opposite distal end.

26. The fuel distributor of claim 23, wherein said low pressure fuel supply means further includes a low pressure supply passage formed in said distributor housing and positioned for continuous fluidic communication with said at least one annular cooling groove, said drain flow circuit being in continuous fluidic communication with said at least one annular cooling groove.

27. The fuel distributor of claim 23, wherein said refill and cooling means further functions for intermittently supplying refill fuel to said receiving passage and said supply inlet passage between injection events.

28. The fuel distributor of claim 27, wherein said receiving passage includes an annular receiving groove, said refill and cooling means including a plurality of refill connector grooves formed in said rotor and spaced circumferentially around said outer surface of said rotor, said refill and cooling means further including a refill branch passage formed in said distributor housing for sequentially communicating with said plurality of refill connector grooves during rotation of said rotor.

29. The fuel distributor of claim 28, wherein said refill branch passage is in continuous fluidic communication with said at least one annular cooling groove.

30. The fuel distributor of claim 26, wherein said drain flow circuit includes an annular clearance gap formed between said outer surface of said rotor and said distributor housing.

31. A fuel distributor for a high pressure fuel injection system capable of distributing pressurized fuel to plural fuel injection lines associated with cylinders of a multicylinder internal combustion engine, comprising:

a distributor housing including a supply inlet circuit, a plurality of delivery passages and a bore;

a fuel distribution rotor rotatably mounted in said bore, said rotor including a receiving passage for receiving supply fuel from said supply inlet circuit and an outlet port formed in an outer surface of said rotor and fluidically connected to said receiving passage, said outlet port positioned for sequential alignment with said plurality of delivery passages; and a rotor cooling means for cooling said rotor during operation, said rotor cooling means including a cooling circuit formed in said outer surface of said rotor adjacent said outlet port and a continuous cooling fuel supply means for continuously delivering cooling fuel to said cooling circuit during rotation of said rotor to maintain a continuous flow of cooling fuel through said cooling circuit throughout rotation of said rotor, said rotor cooling means further including an intermittent cooling flow supply means for intermittently supplying cooling fuel to said receiving passage and said supply inlet circuit between injection events.

32. The fuel distributor of claim 31, wherein said cooling circuit includes at least one annular cooling groove formed in said outer surface of said rotor.

33. The fuel distributor of claim 32, wherein said at least one annular cooling groove includes a first annular cooling groove positioned on one side of said outlet port and a second annular cooling groove positioned on an opposite side of said outlet port.

34. The fuel distributor of claim 33, wherein said continuous cooling fuel supply means includes a supply passage formed in said distributor housing and positioned for continuous fluidic communication with said first annular cooling groove, said cooling circuit further including at least one axial groove extending between said first and said second annular cooling grooves.

35. The fuel distributor of claim 31, wherein said intermittent cooling flow supply means including a plurality of connector passages formed in said rotor in fluidic communication with said receiving passage and spaced circumferentially around said rotor, said intermittent cooling flow supply means further including at least one branch passage formed in said distributor housing for sequentially communicating with said plurality of connector passages during rotation of said rotor.

36. The fuel distributor of claim 35, wherein said at least one branch passage includes a first branch passage fluidically connected to said continuous cooling fuel supply means upstream of said coolant circuit and a second branch passage fluidically connected to said coolant circuit.

37. The fuel distributor of claim 31, wherein said continuous cooling fuel supply means includes a drain flow circuit in fluidic communication with said cooling circuit, said drain flow circuit including an annular clearance gap formed between said outer surface of said rotor and said distributor housing.

38. The fuel distributor of claim 31, further including a pressure balancing means for balancing fuel pressure forces acting on said rotor during rotation, said pressure balancing means including a pressure area defining means for defining a high pressure area on said outer surface of said rotor adjacent said outlet port on which fuel pressure acts during an injection event, wherein said pressure balancing means further includes two balancing ports formed in said outer surface of said rotor on an opposite side of said rotor from said outlet port.

39. A fuel distributor for a high pressure fuel injection system capable of distributing pressurized fuel to plural fuel injection lines associated with cylinders of a multicylinder internal combustion engine, comprising:

a distributor housing including a supply inlet circuit, a plurality of delivery passages and a bore;

a fuel distribution rotor rotatably mounted in said bore, said rotor including a receiving passage for receiving supply fuel from said supply inlet circuit and an outlet port formed in an outer surface of said rotor and fluidically connected to said receiving passage, said outlet port positioned for sequential alignment with said plurality of delivery passages; and a rotor cooling means for cooling said rotor during operation including a cooling circuit formed in said rotor and a cooling fuel supply means for delivering cooling fuel to said cooling circuit during rotation of said rotor, said cooling circuit including at least one annular cooling groove formed in said outer surface of said rotor adjacent said outlet port and extending circumferentially completely around said rotor, wherein said at least one annular cooling groove includes a first annular cooling groove positioned on one side of said outlet port and a second annular cooling groove positioned on an opposite side of said outlet port.

40. The fuel distributor of claim 39, wherein said cooling fuel supply means includes a supply passage formed in said distributor housing and positioned for continuous fluidic communication with said first annular cooling groove, said cooling circuit further including at least one axial groove extending between said first and said second annular cooling grooves.

41. The fuel distributor of claim 39, wherein said rotor cooling means further includes an intermittent cooling flow supply means for intermittently supplying cooling fuel to said receiving passage and said supply inlet circuit between injection events.

42. The fuel distributor of claim 41, wherein said intermittent cooling flow supply means includes a plurality of connector grooves formed in said rotor and spaced circumferentially around said outer surface of said rotor, said intermittent cooling flow supply means further including at least one branch passage formed in said distributor housing for sequentially communicating with said plurality of connector grooves during rotation of said rotor.

43. The fuel distributor of claim 42, wherein said at least one branch passage includes a first branch passage fluidically connected to said continuous cooling fuel supply means upstream of said coolant circuit and a second branch passage fluidically connected to said coolant circuit.

44. The fuel distributor of claim 39, wherein said cooling fuel supply means includes a drain flow circuit in fluidic communication with said cooling circuit, said drain flow circuit including an annular clearance gap formed between said outer surface of said rotor and said distributor housing.

45. The fuel distributor of claim 39, further including a pressure balancing means for balancing fuel pressure forces acting on said rotor during rotation, said pressure balancing means including a pressure area defining means for defining a high pressure area on said outer surface of said rotor adjacent said outlet port on which fuel pressure acts during an injection event, said pressure balancing means further including two balancing ports formed in said outer surface of said rotor on an opposite side of said rotor from said outlet port.

46. A fuel distributor for a high pressure fuel injection system capable of distributing pressurized fuel to plural fuel injection lines associated with cylinders of a multicylinder internal combustion engine, comprising:

a distributor housing including a supply inlet circuit, a plurality of delivery passages and a bore;

a fuel distribution rotor rotatably mounted in said bore, said rotor including a receiving passage for receiving supply fuel from said supply inlet circuit and an outlet port formed in an outer surface of said rotor and fluidically connected to said receiving passage, said outlet port positioned for sequential alignment with said plurality of delivery passages; and a refill means for delivering a supply of low pressure refill fuel to at least one of said supply inlet circuit and said plurality of delivery passages between injection events, said refill means including intermittent supply refill means for intermittently supplying low pressure fuel to said supply inlet circuit, said intermittent supply refill means including a plurality of refill connector grooves formed in said outer surface of said rotor and extending axially along said fuel distribution rotor.

47. The fuel distributor of claim 46, wherein said refill means includes first and second refill grooves formed in said outer surface of said rotor, said first and said second refill grooves positioned on opposite sides of said outlet port in a common transverse plane extending through said outlet port, each of said first and said second refill grooves including a first end positioned adjacent said outlet port and an opposite distal end.

48. The fuel distributor of claim 47, wherein said refill means includes an annular groove extending circumferentially completely around said rotor and a supply passage formed in said distributor housing for continuous fluidic communication with said annular groove, said refill means further including respective axial grooves extending between said annular groove and each of said first and said second refill grooves.

49. The fuel distributor of claim 46, wherein said plurality of refill connector grooves are spaced circumferentially around said outer surface of said rotor, said intermittent supply refill means further including at least one branch passage formed in said distributor housing for sequentially communicating with said plurality of connector grooves during rotation of said rotor.

50. The fuel distributor of claim 46, further including a pressure balancing means for balancing fuel pressure forces acting on said rotor during rotation, said pressure balancing means including a pressure area defining means for defining a high pressure area on said outer surface of said rotor adjacent said outlet port on which fuel pressure acts during an injection event, said pressure balancing means further including two balancing ports formed in said outer surface of said rotor on an opposite side of said rotor from said outlet port.

51. A fuel distributor for a high pressure fuel injection system capable of distributing pressurized fuel to plural fuel injection lines associated with cylinders of a multicylinder internal combustion engine, comprising:

a distributor housing including a supply inlet circuit, a plurality of delivery passages and a bore;

a fuel distribution rotor rotatably mounted in said bore, said rotor including a receiving passage for receiving supply fuel from said supply inlet circuit and an outlet port formed in an outer surface of said rotor and fluidically connected to said receiving passage, said outlet port positioned for sequential alignment with said plurality of delivery passages; and a rotor cooling means for cooling said rotor during operation, said rotor cooling means including a cooling circuit formed in said outer surface of said rotor adjacent said outlet port and a continuous cooling fuel supply means for continuously delivering cooling fuel to said cooling circuit during rotation of said rotor to maintain a continuous flow of cooling fuel through said cooling circuit throughout rotation of said rotor, said cooling circuit including at least one annular cooling groove formed in said outer surface of said rotor, wherein said at least one annular cooling groove includes a first annular cooling groove positioned on one side of said outlet port and a second annular cooling groove positioned on an opposite side of said outlet port.

52. A fuel distributor for a high pressure fuel injection system capable of distributing pressurized fuel to plural fuel injection lines associated with cylinders of a multicylinder internal combustion engine, comprising:

a distributor housing including a supply inlet circuit, a plurality of delivery passages and a bore;

a fuel distribution rotor rotatably mounted in said bore, said rotor including a receiving passage for receiving supply fuel from said supply inlet circuit and an outlet port formed in an outer surface of said rotor and fluidically connected to said receiving passage, said outlet port positioned for sequential alignment with said plurality of delivery passages; and a rotor cooling means for cooling said rotor during operation, said rotor cooling means including a cooling circuit formed in said outer surface of said rotor adjacent said outlet port and a continuous cooling fuel supply means for continuously delivering cooling fuel to said cooling circuit during rotation of said rotor to maintain a continuous flow of cooling fuel through said cooling circuit throughout rotation of said rotor, said continuous cooling fuel supply means including a drain flow circuit in fluidic communication with said cooling circuit, said drain flow circuit including an annular clearance gap formed between said outer surface of said rotor and said distributor housing.

53. A fuel distributor for a high pressure fuel injection system capable of distributing pressurized fuel to plural fuel injection lines associated with cylinders of a multicylinder internal combustion engine, comprising:

a distributor housing including a supply inlet circuit, a plurality of delivery passages and a bore;

a fuel distribution rotor rotatably mounted in said bore, said rotor including a receiving passage for receiving supply fuel from said supply inlet circuit and an outlet port formed in an outer surface of said rotor and fluidically connected to said receiving passage, said outlet port positioned for sequential alignment with said plurality of delivery passages; and a refill means for delivering a supply of low pressure refill fuel to at least one of said supply inlet circuit and said plurality of delivery passages between injection events, wherein said refill means includes first and second refill grooves formed in said outer surface of said rotor, said first and said second refill grooves positioned on opposite sides of said outlet port in a common transverse plane extending through said outlet port, each of said first and said second refill grooves including a first end positioned adjacent said outlet port and an opposite distal end.

* * * * *